United States Patent [19]

Hixson

[11] 4,312,477

[45] Jan. 26, 1982

[54] RAIL FASTENER ASSEMBLY

[76] Inventor: Richard M. Hixson, 4140 Thunderbird Dr., Marietta, Ga. 30067

[21] Appl. No.: 128,490

[22] Filed: Mar. 10, 1980

Related U.S. Application Data

[63] Continuation of Ser. No. 910,111, May 30, 1978, abandoned.

[51] Int. Cl.[3] ..... E01B 9/48

[52] U.S. Cl. ..... 238/304; 238/310; 238/338; 238/349; 238/351

[58] Field of Search ..... 238/217, 310, 315, 338, 238/343, 349, 287, 304, 351

[56] References Cited

U.S. PATENT DOCUMENTS

| | | | |
|---|---|---|---|
| 1,863,145 | 6/1932 | Young | 238/349X |
| 2,724,558 | 11/1955 | Jones | 238/349 X |
| 3,314,605 | 4/1967 | Waters | 238/349 X |
| 3,784,097 | 1/1974 | Landis | 238/310 |
| 3,986,667 | 10/1976 | Heim | 238/349 |
| 4,143,818 | 3/1979 | Matsubara et al. | 238/338 X |

FOREIGN PATENT DOCUMENTS

| | | | |
|---|---|---|---|
| 226776 | 6/1959 | Australia | 238/349 |
| 1021751 | 11/1977 | Canada | 238/349 |
| 2409373 | 10/1974 | Fed. Rep. of Germany | 238/349 |

*Primary Examiner*—Randolph A. Reese
*Attorney, Agent, or Firm*—Larson and Taylor

[57] ABSTRACT

A railroad fastener assembly is provided for securing a rail in place. The rail fastener assembly includes a base plate, at least two rail locator members, formed integrally with the base plate and located on opposite sides of the rail for locating the rail in position relative to the base plate, at least two clip holders formed integrally with the base plate; and a resilient clip associated with each clip holder for engaging the base flange of the rail to secure the rail in place. The resilient clips each comprise an elongate substantially planar member including a rail engaging, proximal end. The clip holders each include an aperture through which the associated clip extends and which defines a fulcrum for the clip. A pair of integral upwardly facing support surfaces of each clip holder is of height relative to the aperture so as to provide for capture of the distal end of the associated clip between the support surface and the aperture and thus provide deflection of the clip about the fulcrum so that the proximal end of the clip is biased into engagement with the rail. Shoulders formed on the support surfaces serve in approximately positioning the associated rail clip.

9 Claims, 7 Drawing Figures

RAIL FASTENER ASSEMBLY

This is a continuation of application Ser. No. 910,111, filed May 30, 1978, now abandoned.

FIELD OF THE INVENTION

The present invention relates to an improved rail fastener for securing the base flange of a railroad rail in place.

BACKGROUND OF THE INVENTION

A number of devices have been developed for fastening or securing railway rails in place, i.e., to sleepers or ties fabricated of wood, concrete and other materials. These devices characteristically include a rail clip which is adapted at one end thereof to engage the base flange of the rail and which is supported by some form of anchor secured in the foundation on which the rail is mounted, e.g., in a concrete sleeper. The clip is generally fabricated of a resilient metal so as to provide flexible engagement with the rail and is insulated from the rail by a suitable insulator.

Examples of rail fastener devices of the type discussed above are disclosed in U.S. Pat. Nos. 2,724,558 (Jones); 3,429,505 (Newton); 3,515,347 (Waters et al); 3,881,652 (Jacobson); and 3,887,128 (Ruble), although, of course, this listing is not in any way represented to be exhaustive. Briefly considering these patents, the Jones patent discloses a rail anchor tie plate wherein one end of a rocker plate extends through a rocker bar to engage the rail and the other end is rockably mounted by a jack screw. The Newton patent discloses a rail to tie fastener wherein a clip engages the rail and the tie at opposite ends thereof and a fastener member screwed into the tie includes a stem which extends through the clip. A spring arrangement mounted on the stem engages the upper surface of the clip. The Waters et al patent discloses a rail fastening device wherein a bifurcated rail clip engages the rail at the proximal end thereof and a back support at the distal end thereof, the clip extending through a reaction piece secured to the tie or sleeper. The Jacobson patent discloses a rail fastening assembly including a resilient rail clip of a specialized shape. The Ruble patent discloses a rail fastener wherein one end of a L-shaped rail clip engages the rail and the other end bears downwardly on the base portion of an anchor member. A cross pin mounted in the anchor member engages the clip intermediate the ends thereof.

While the rail fasteners of the prior art will carry out the function for which they are designed, such prior art fasteners suffer a number of disadvantages from standpoints of complexity of design, ease of manufacture and the like. A further important disadvantage involves the ease of assembly or installation of the fastener, particularly with respect to locking or otherwise fixing the rail clip in place.

A further rail fastening assembly of interest here is that disclosed in my earlier patent, U.S. Pat. No. 3,858,804 (Hixson). This fastening assembly includes a base assembly comprising a sandwich formed by upper and lower plates having an elastomer sheet disposed therebetween, and a number of different rail clip embodiments are disclosed in the patent.

SUMMARY OF THE INVENTION

In accordance with the invention, a rail fastener assembly is provided which overcomes many of the problems associated with rail fasteners of the prior art. The instant rail fastener assembly is extremely simple and rugged in construction and the resilient spring clip associated therewith basically constitute the only parts which are not integral with a base plate. The rail fastener assembly of the invention enables elimination of the three layer sandwich construction disclosed in my earlier patent (U.S. Pat. No. 3,858,804) referred to above and the clip holders themselves constitute a non-threaded support for the associated spring clip which biasses the clip into engagement with the rail. Further, the clip holders of the invention are substantially more rugged and are easier to install than the fasteners disclosed in the Jones, Waters et al and Ruble patents discussed above, owing in part to the integral construction with the base plate and the elimination of separate support members (as provided in the Waters et al patent) and adjustment members (as provided in the Jones patent).

In accordance with a preferred embodiment, the rail fastener assembly of the invention comprises a base plate, at least two rail locator members formed integrally with the base plate for locating the rail in position relative to the upper surface of the base plate, the rail locators being disposed on opposite sides of the rail when the rail is in place on the base plate; at least two clip holders formed integrally with said base plate; and a resilient clip associated with each said clip holder for engaging the base flange of the rail to secure the rail in place. The resilient clips each comprise an elongate substantially planar member including a rail engaging, proximal end and the clip holders each include means defining an aperture therein through which the associated clip extends and which defines a fulcrum for the clip, and clip supporting and constraining means, including an integral upwardly facing support surface whose height relative to said aperture provides for capture of the distal end of the associated clip between the support surface and the aperture defining means so that the clip can be deflected about said fulcrum, for supporting and constraining the distal end of the clip such that the rail engaging proximal end of the clip is deflected when in engagement with the rail and is thereby biased into engagement therewith.

Preferably, the support surface is a continuation of the means defining the lowermost portion of the aperture and comprises an inclined surface. Advantageously, the support surface comprises the upwardly facing surfaces of a pair of spaced, raised integral leg members which extend in a direction away from the rail. These leg members preferably include means for fixing the position of the resilient clip relative to said support surface, which means, in a preferred embodiment, comprises a raised shoulder located on each of said upwardly facing surfaces of the leg member against which the distal end of the resilient clip abuts. According to this embodiment, the resilient clip includes a tongue or tab portion which extends outwardly from the distal end thereof in the same plane and is positioned between, i.e., extends between, the raised shoulders.

The locator members are preferably wedge shaped in cross section and include a substantially upright planar endwall which faces the base flange of the rail. In one embodiment of the invention, the bottom surface of the base plate is inclined, with the amount of slope or inclination of said base plate being one part to forty. In an embodiment adapted for use with concrete foundations, steel ties and the like, the base plate is disposed in a recess in the upper surface of an elastomer body and an anchoring means, including an upstanding portion of said elastomer body, is provided for anchoring the assembly to the support foundation. In a further embodiment adapted for use with wood ties, the elastomer body is eliminated.

Other features and advantages of the invention will be set forth in, or apparent from, the detailed description of the preferred embodiments found hereinbelow.

DESCRIPTION OF THE PREFERRED EMBODIMENTS

Referring to FIGS. 1 to 4, a first embodiment of the invention is shown. The rail fastener assembly of this embodiment, like that of FIG. 5 described below, is particularly adapted to be secured to a concrete base structure, steel beams or the like, in generally the same way as the fastening assembly disclosed in my earlier patent (U.S. Pat. No. 3,858,804) referred to above.

Figure 1:
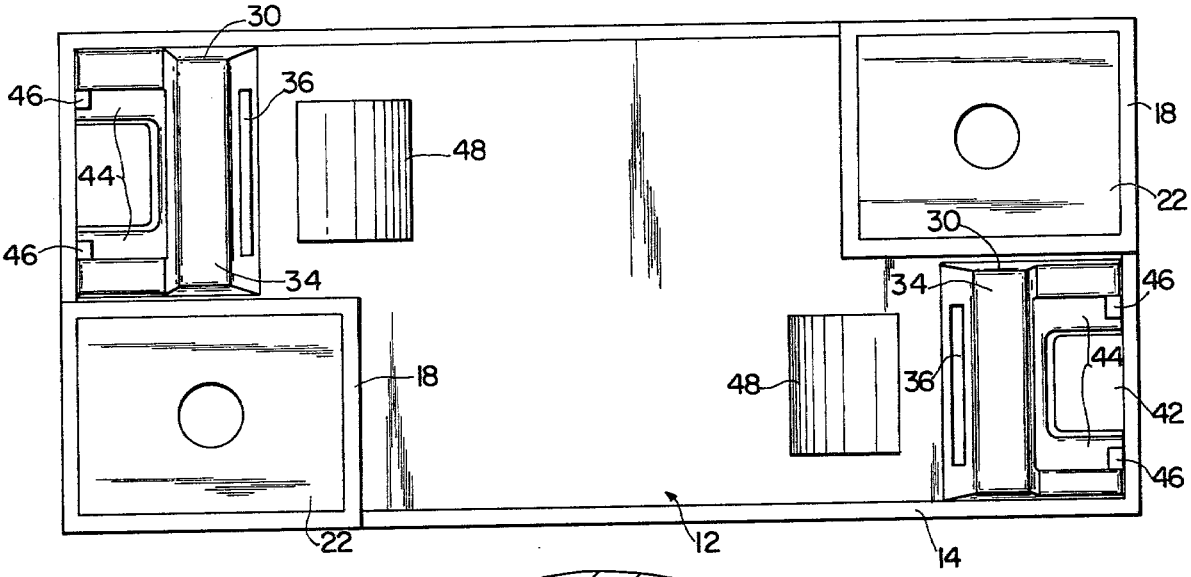
FIG. 1 is a plan view of a first embodiment of the rail fastener assembly of the invention.
Figure 2:
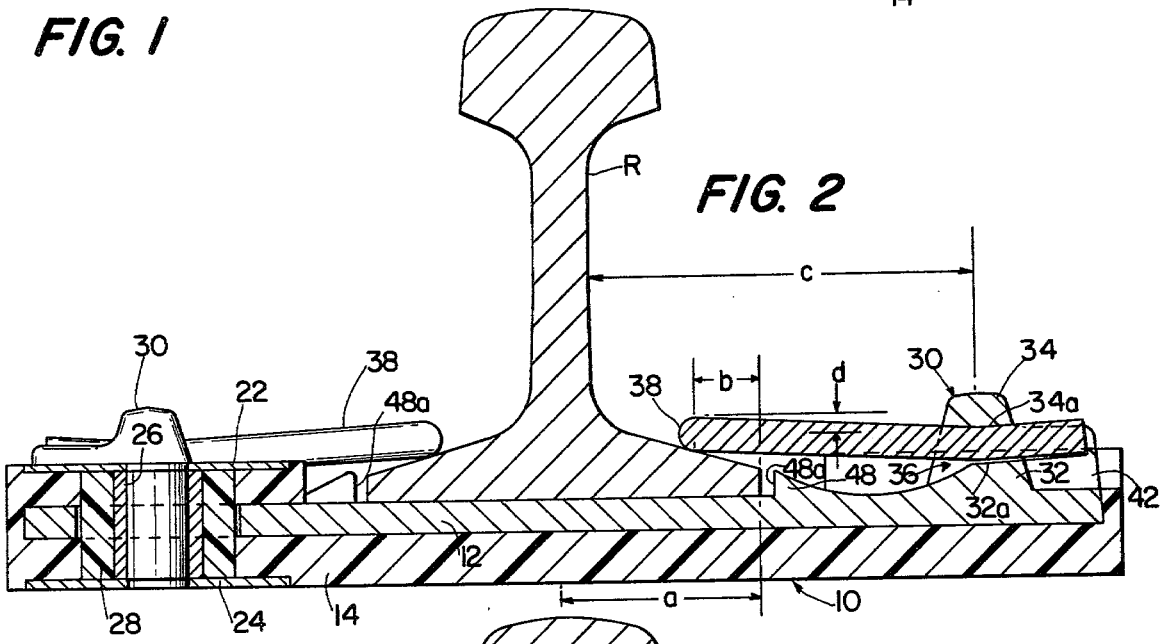
FIG. 2 is a transverse cross sectional view of the rail fastener assembly of FIG. 1.

The rail fastener assembly of FIGS. 1 to 4, which is generally denoted 10, includes a base plate 12 fabricated of metal and an elastomer body 14 on which base plate 12 is seated. As perhaps can be best seen in FIG. 1, a sidewall portion of the elastomer surrounds the peripheral edge of base plate 12 so that plate 12 is disposed within a recessed area in the upper surface of elastomer body 14. Elastomer body 14 also includes a pair of generally rectangular anchor portions 18 which are located at opposite corners thereof and which project above the surface of the base plate 12, as illustrated. Each anchor portion 18 is part of an anchoring device which, as shown in FIG. 2, includes upper and lower plates 22 and 24, a spacer sleeve 26, and an insert 28. It will be understood that, in use, an anchoring bolt or the like (not shown) will extend through the opening in sleeves 26 and the holes in plates 22,24 into the foundation to provide anchoring of the rail fastener assembly.

Figure 4:
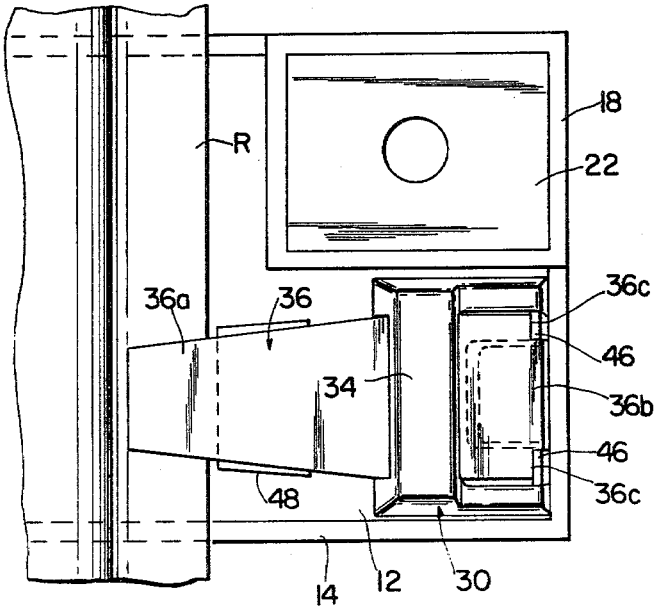
FIG. 4 is a partially broken away plan view similar to that of FIG. 1 with the spring clips in place.

The fastener base plate 12 includes a pair of rail clip holders 30 formed integrally therewith and located in diagonally opposed corners thereof as illustrated in FIG. 1. Clip holders 30 each comprise a base portion 32 and a head or crown portion 34 which define a slot or aperture 36 therebetween. As shown in FIG. 2, the slot-defining surface of 34*a* of head portion 34 is rounded in cross section while the slot-defining surface 32*a* of base portion 32 is inclined forwardly. Slot 36 is adapted to receive a spring clip 38 which is described in more detail hereinbelow and which extends therethrough, as indicated in FIGS. 2 and 4, to engage a rail R. Clip holder 30 also includes upright sidewall portions 40 which extend upwardly from base portion 32 and between which spring clip 38 extends. A recess 42 provided in base portion 32 defines two rearwardly extending legs 44. A pair of shoulders 46 are formed on the upper surface of the legs 44 of base portion 32 at the distal ends thereof, i.e., at the ends remote from rail R.

Figure 3:
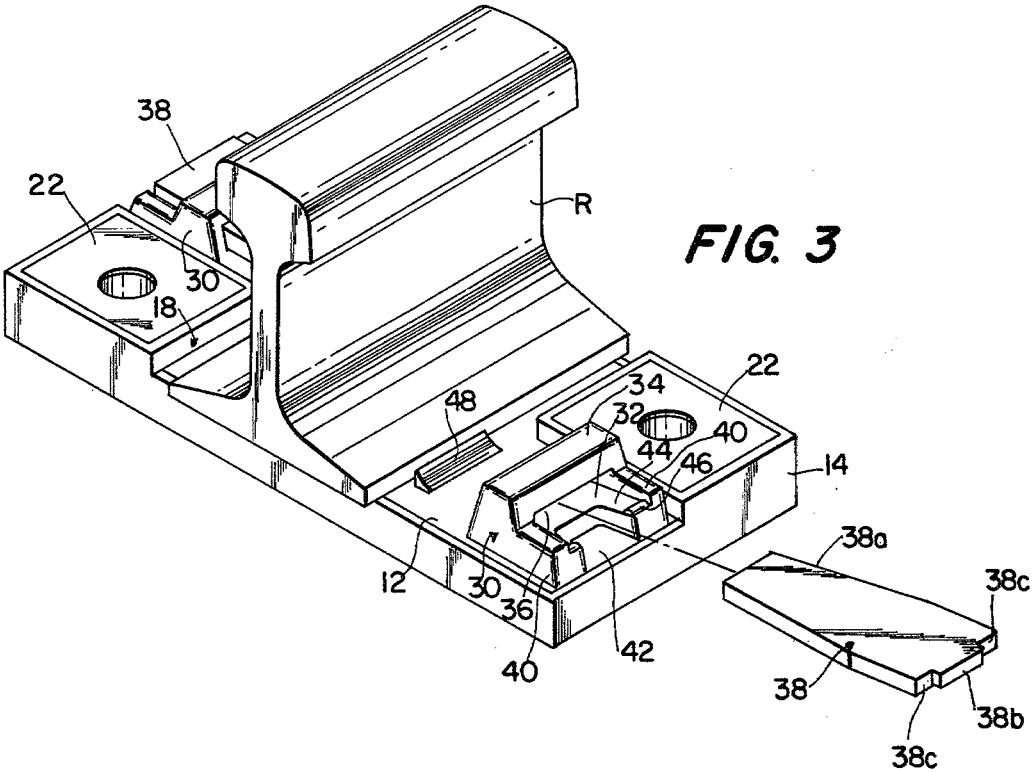
FIG. 3 is a partially exploded perspective view of the rail fastener assembly of FIG. 1.

As can best be seen in FIG. 3, spring clip 38 comprises an elongate planar member which is tapered at one end, denoted 38*a*, and includes a tongue or tab portion 38*b* which extends outwardly from the other end centrally thereof between distal edges 38*c*,38*c*.

Base plate 12 also includes a pair of rail locators or stops 48 formed integrally therewith and disposed in front of, i.e., inwardly of, clip holders 30. As shown, for example, in FIG. 1, rail locators 48 each comprise a wedge-shape member which presents substantially upright surface 48*a* facing the lateral edge of the base flange of rail R.

As illustrated in FIGS. 1 and 4, in order to secure or fix rail R in place on base plate 12, spring clips 38 are inserted through slots 36 in clip holders 30 so that the tapered ends 38*a* engage the base flange of rail R. With each spring clip 38 so positioned, the distal end portion thereof engages and rests on the upper surface of base portion 32 and the distal edges 38*c*, 38*c* located on the opposite sides of tongue 38*b* engage the shoulders 46 on the upper surface of rearwardly extending legs 44 of base portion 32. The dimensions of each spring clip 38 relative to the corresponding slot 36 and clip holder 30 is such that clip 38 is flexed about surface 34*a* of head portion 34 which serves as a fulcrum or pivot area. As can best be seen in FIG. 2, the distal end of spring clip 38 is captured between aperture defining surface 34*a* and the clip support surfaces defined by legs 44 so as to fix this end and provide for deflection of clip 38 about surface 34*a*. As shown in FIG. 2, the tapered proximal end 38*a* of clip 38 is deflected a predetermined amount from the position it would assume if rail R were removed, by virtue of the action of clip holder 30 in fixing the distal end of clip 38 in place. In a specific example, where the distance "a" between the center line of the rail R and the outer edge of the base flange of the rail is $2\frac{3}{4}$ inches, the distance "b" between the point of contact of clip 38 and the edge of the base flange is one inch, and the distance "c" between center line A of head portion 34 of clip holder 30 is 5 21/32 inches, the deflection "d" of the clip 38 is 5/16 inches. It will, of course, be appreciated that distance between the centerline of rail R and the centerline of head portion 34 is a design variable and that the amount of deflection provided for, and hence the biassing or retaining force provided by spring clip 38, can be varied, within limits, as required. In the operative position of spring clip 38, tongue or tab 38*b* extends beyond shoulders 46 and, because clip 38 rests on legs 44, is spaced from the plane of base plate 12 in the area of recess 42 so as to enable clip 38 to be gripped or engaged by a tool for removal.

Figure 5:
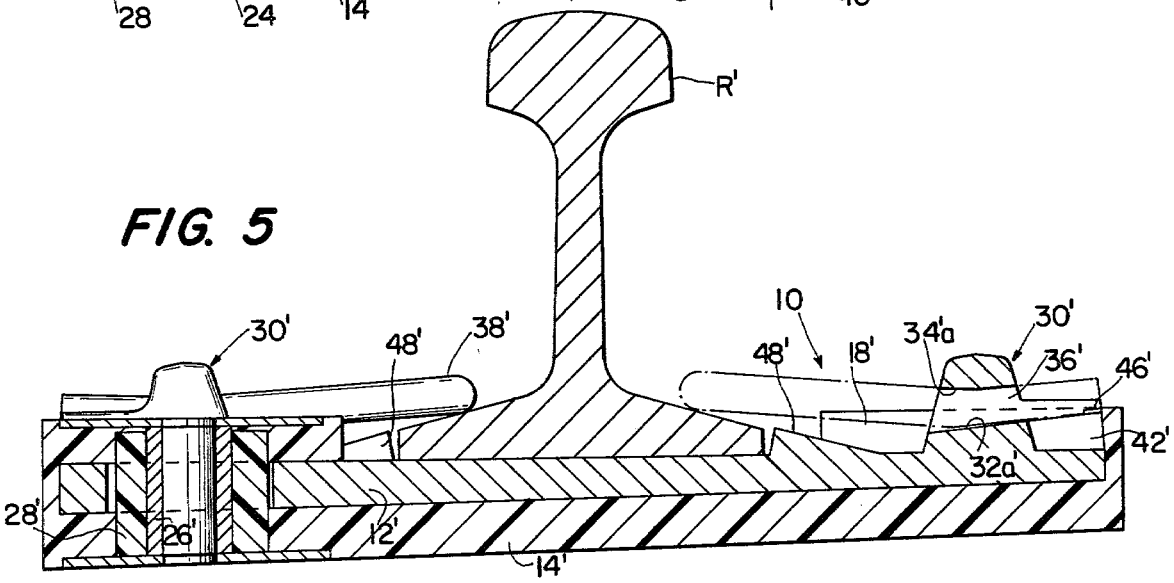
FIG. 5 is a transverse cross sectional view similar to that of FIG. 2, illustrating a second embodiment of the rail fastener assembly of the invention.

Referring to FIG. 5, a further embodiment of the invention is illustrated. The embodiment of the invention of FIG. 5 is similar to that of FIGS. 1 to 4 and corresponding elements have been given the same serial numbers with primes attached, apart from minor differences regarding the shape of the inclined slot-defining surface 32*a*′ and the size of locator member 48′, the chief difference between the two embodiments is the provision in the embodiment of FIG. 5 of a sloping or canted bottom surface for base plate 12′ and elastomer body 14′, as illustrated. In a specific embodiment, a slope of 1:40 is provided. This feature aids in fixing the entire rail fastener assembly 10' in place during operation.

Figure 6:
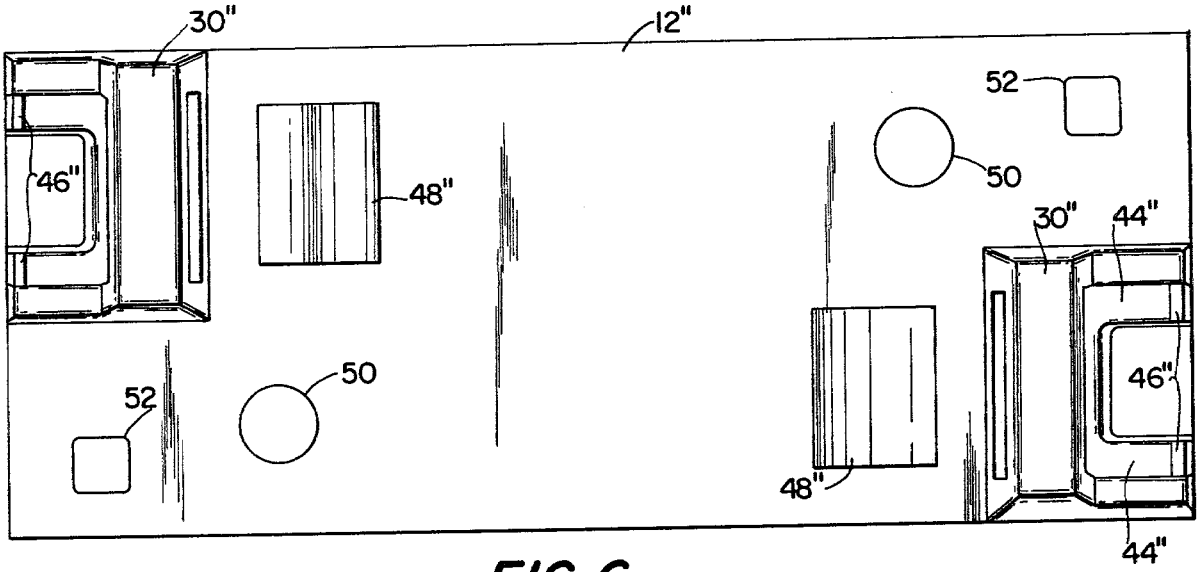
FIG. 6 is a plan view of a third embodiment of the invention.
Figure 7:
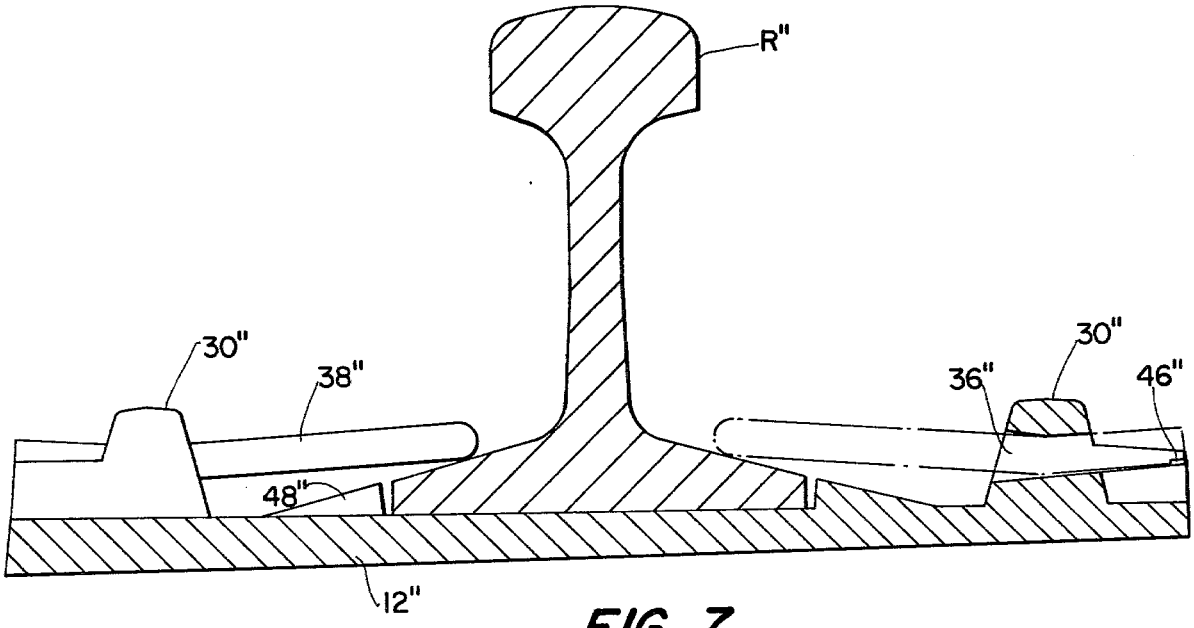
FIG. 7 is a transverse cross sectional view of the rail fastener assembly of FIG. 6.

Referring to FIGS. 6 and 7, another embodiment of the invention is shown. This embodiment is also similar to that of FIGS. 1 to 4 and corresponding elements have been given the same numbers with double primes attached. The embodiment of FIGS. 6 and 7 is adapted for use in a situation where the fastener assembly is to be secured to wood ties and the elastomer body (bodies 14 and 14') provided in the embodiments of FIGS. 1 to 4 and FIG. 5, is dispensed with. The embodiment of FIGS. 6 and 7 is similar to that of FIG. 5 in that the base plate 12'' is provided with a similar stop and the shape of the upper or slot-defining surface **32*a*'' of base portion 32'' of clip holder 30'' is also similar. The manner of installation of the clips 38'' and the function performed by the device is also similar to that of the other embodiments, although in this embodiment a pair of round holes 50 and a pair of square holes 52** are employed in fixing the fastener to the wood ties.

Although the invention has been described relative to exemplary embodiments thereof, it will be understood that other variations and modifications can be effected in these embodiments without departing from the scope and spirit of the invention.

I claim:

1. A railroad rail fastener assembly for securing a rail having a base flange in place, said rail fastener assembly comprising at least two clip holders and a resilient clip associated with each said clip holder for engaging the base flange of the rail to secure the rail in place; each said resilient clip comprising an elongate substantially planar member including a rail engaging, proximal end and said clip holders each including means defining an aperture therein through which the associated clip extends and which defines a fulcrum for said clip, and clip supporting and constraining means, including an integral upwardly facing support surface whose height relative to said aperture provides for capture of the distal end of the associated clip between said surface and said aperture defining means so that said clip can be deflected about said fulcrum, for supporting and constraining the distal end of said clip such that the said rail engaging proximal end of said clip is deflected when in engagement with said rail and thereby biased into engagement therewith, said support surface gradually sloping upwardly in a direction away from said rail and comprising the upwardly facing surfaces of a pair of spaced integral leg members which extend in a direction away from the rail, said leg members including means for fixing the position of said resilient clip relative to said support surface, said position fixing means comprising a raised shoulder located on each of said upwardly facing surfaces of said leg members against which the distal end of said resilient clip abuts, said resilient clip including a central tongue portion which extends outwardly from the distal end thereof in the same plane and portions of the distal end of said clip lying on opposite sides of said central tongue portion which engage the upwardly facing surfaces of said leg members and are adapted to abut the corresponding raised shoulders on the upwardly facing surfaces of said leg members.

2. A railroad rail fastener assembly as claimed in claim 1 wherein said support surface is a continuation of the means defining the lowermost portion of said aperture.

3. A railroad rail fastener assembly as claimed in claim 1 wherein said clip holders are both formed integrally with a base plate.

4. A railroad rail fastener assembly as claimed in claim 3 further comprising at least two rail locator means formed integrally with said base plate for locating the rail in position relative to the upper surface of said base plate.

5. A railroad rail fastener assembly as claimed in claim 4 wherein said locator members are wedge-shaped in cross section and include a substantially upright planar endwall which faces the base flange of the rail.

6. A railroad rail fastener assembly as claimed in claim 3 wherein the bottom surface of said base plate is inclined.

7. A railroad rail fastener assembly as claimed in claim 6 wherein the amount of inclination of said base plate is one part to forty.

8. A railroad rail fastener assembly as claimed in claim 1 wherein said base plate is disposed in a recess in the upper surface of an elastomer body.

9. A railroad rail fastener assembly as claimed in claim 8 wherein said assembly further comprises anchoring means including an upstanding portion of said elastomer body for anchoring the assembly to a support foundation.

* * * * *